US006840814B2

(12) United States Patent
Fukuda et al.

(10) Patent No.: US 6,840,814 B2
(45) Date of Patent: Jan. 11, 2005

(54) CONNECTOR FOR PRINTED CIRCUIT BOARD

(75) Inventors: Masaru Fukuda, Shizuoka-ken (JP); Toshikaki Okabe, Shizuoka-ken (JP); Tetsuya Yamashita, Shizuoka-ken (JP); Keiichi Ito, Aichi-ken (JP); Masanori Wakui, Toyota (JP); Isao Yoneyama, Chiryu (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/214,195

(22) Filed: Aug. 8, 2002

(65) Prior Publication Data

US 2003/0032329 A1 Feb. 13, 2003

(30) Foreign Application Priority Data

Aug. 9, 2001 (JP) ..... 2001-242025

(51) Int. Cl.[7] ..... H01R 33/94
(52) U.S. Cl. ..... 439/654; 439/595
(58) Field of Search ..... 439/654, 79, 83, 439/595

(56) References Cited

U.S. PATENT DOCUMENTS

| | | | | | |
|---|---|---|---|---|---|
| 3,539,965 | A | * | 11/1970 | Morehart et al. | 439/75 |
| 3,697,926 | A | | 10/1972 | Krafthefer | |
| 3,907,392 | A | * | 9/1975 | Haag et al. | 439/218 |
| 4,189,199 | A | | 2/1980 | Grau | |
| 4,813,881 | A | * | 3/1989 | Kirby | 439/74 |
| 4,878,849 | A | * | 11/1989 | Talwar et al. | 439/79 |
| 5,308,248 | A | * | 5/1994 | Davidge et al. | 439/59 |
| 5,399,108 | A | | 3/1995 | Lu et al. | |
| 5,582,519 | A | | 12/1996 | Buchter | |
| 6,171,126 | B1 | | 1/2001 | Wu et al. | |
| 6,200,146 | B1 | * | 3/2001 | Sarkissian | 439/79 |
| 6,315,594 | B1 | * | 11/2001 | Yanagida | 439/357 |
| 6,315,620 | B1 | * | 11/2001 | Moir et al. | 439/862 |
| 6,530,786 | B2 | * | 3/2003 | Ishikawa | 439/79 |

FOREIGN PATENT DOCUMENTS

| | | |
|---|---|---|
| EP | 0 567 196 A1 | 10/1993 |
| EP | 0 708 504 A2 | 4/1996 |
| EP | 0 717 463 A2 | 6/1996 |
| JP | 7-272803 | 10/1995 |
| JP | 2000-21512 | 1/2000 |

* cited by examiner

*Primary Examiner*—Tho D. Ta
(74) *Attorney, Agent, or Firm*—Finnegan, Henderson, Farabow, Garrett, & Dunner, L.L.P.

(57) ABSTRACT

A connector is provided with a connector housing including one or more terminal housing chambers each including a first open end and a second open end; and one or more terminals each comprising a contact portion at a distal end thereof for contacting the opposite terminal and a solder tail extended from a proximal end thereof. The terminals are respectively housed in the terminal housing chambers with setting the distal ends thereof directed to the first open ends. Each terminal has a length so that the proximal end thereof reaches the same level as or protrudes from the second open end when the terminal is completely housed in the respective terminal housing chamber.

10 Claims, 6 Drawing Sheets

CONNECTOR FOR PRINTED CIRCUIT BOARD

BACKGROUND OF THE INVENTION

1. Field of the Invention

The present invention relates to a connector for a printed circuit board with which an opposite connector can be connected from either side thereof, and more particularly such a connector which is easy to be assembled.

2. Description of the Related Art

There is proposed a connector having two connection surfaces on both ends thereof. An opposite connector may be connected with either end of the connector. Which end is selected depends on each case. For example, when one end of the connector does not tolerate the opposite connector because arrangements of the terminals do not accurately match, another end may be available.

SUMMARY OF THE INVENTION

A terminal for the proposed connector is provided with a contact portion and a solder tail. When assembling the proposed connector, terminals are respectively inserted into terminal housing chambers of the proposed connector. The terminal needs to be fully inserted so that the contact portion is recessed in a terminal housing chamber of the proposed connector and the solder tail is extended therefrom. Such an assembly procedure can not be automatically achieved by any production machine. Therefore the proposed connector is assembled by manual procedures so that the productivity is limited. Furthermore, the solder tail is easy to be deformed by the manual procedures so that defective products are often produced.

The present invention was accomplished to solve the above problem and the purpose is provision of a connector which is easy to be assembled and is prevented from deformation.

A connector of the present invention is provided with a connector is provided with a connector housing including one or more terminal housing chambers each including a first open end and a second open end; and one or more terminals each comprising a contact portion at a distal end thereof for contacting the opposite terminal and a solder tail extended from a proximal end thereof. The terminals are respectively housed in the terminal housing chambers with setting the distal ends thereof directed to the first open ends. Each terminal has a length so that the proximal end thereof reaches the same level as or protrudes from the second open end when the terminal is completely housed in the respective terminal housing chamber.

When assembling the connector, the terminal is not necessary to be pressed into the terminal housing chamber in a recessed manner. Instead of the solder tail, the proximal end of the terminal is available for pressing the terminal. It is not necessary to use the solder tail for insertion of the terminal and deformation of the solder tail is prevented. Thereby the productivity is increased and defective products are eliminated.

More preferably, the second open ends respectively comprise guiding bevels for guidance of insertion of the opposite terminals. Thereby insertion of the opposite terminals is easy when the opposite terminals are inserted from a bottom end of the connector housing.

Further preferably, the terminals are respectively provided with guiding portions for guidance of insertion of the opposite terminals into the contact portions. Thereby insertion of the opposite terminals is easy when the opposite terminals are inserted from a bottom end of the connector housing.

DETAILED DESCRIPTION OF THE PREFERRED EMBODIMENT

Figure 1A:
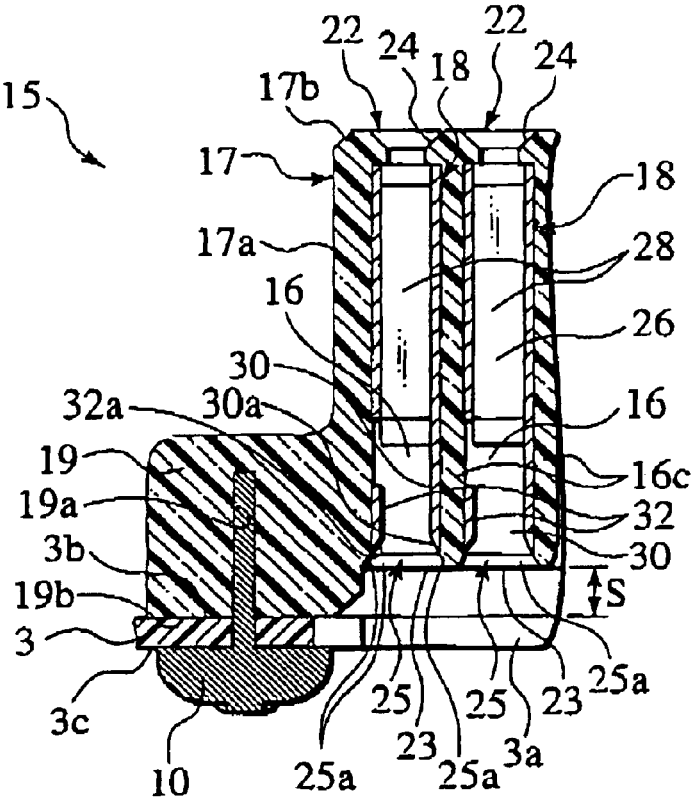
FIG. 1A is a vertical cross sectional view of a connector for a printed circuit board according to an embodiment of the present invention, partially cut off to show a vicinity of an end portion thereof in an assembled state.

An embodiment of the present invention will be described hereinafter in reference to FIGS. 1–7B.

A connector 15 for a printed circuit board is provided with a connector housing 17 including plural terminal housing chambers 16 and plural terminals 18 respectively inserted into the terminal housing chambers 16. The connector 15 is fixed to a printed circuit board 3 having a through-hole 3*a* and is connected to an opposite connector having plural opposite terminals so that the terminals 18 is respectively connected to the opposite terminals.

The connector housing 17 is formed to have a tubular wall portion 17*a* and an upper wall portion 17*b* covering a top end thereof. The connector housing 17 is further provided with a pair of brackets 19 at both sides for fixation thereof to the printed circuit board 3.

Each the bracket 19 comprises an attaching hole 19*a* for receiving a bolt 10 and is projected downward from a bottom end of the connector housing 17. As well as bottom surfaces 19*b* of the brackets 19 are attached to a front surface 3*b* of the printed circuit board 3, the bolts 10 are inserted into the attaching holes 19*a* from a rear surface 3*c* of the printed circuit board 3 and tightened so that the connector housing 17 are fixed to the printed circuit board 3. A gap S is left between the bottom end of the connector housing 17 and the top surface 3*a* as shown in FIG. 1A.

Figure 1B:
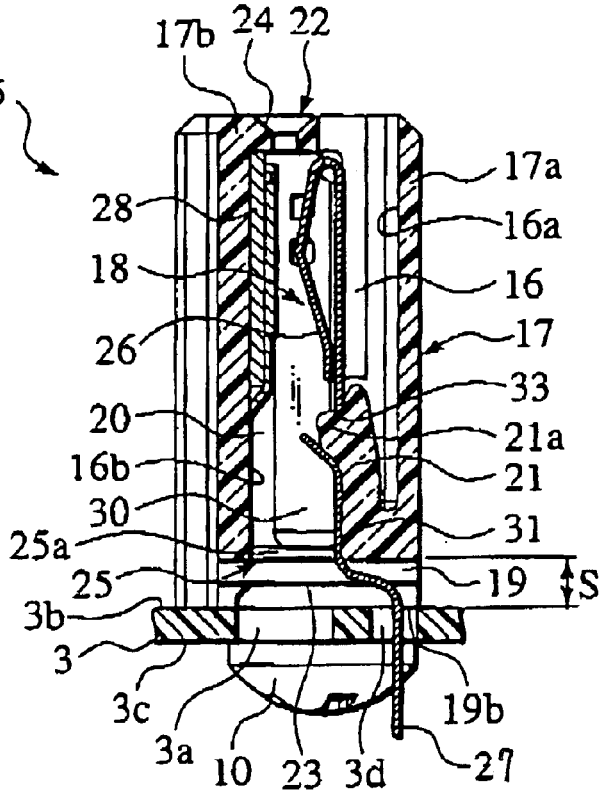
FIG. 1B is a vertical cross sectional view of the connector of the embodiment, showing a cross section orthogonal to FIG. 1A.

The connector housing 17 is provided with plural terminal housing chambers 16 each having a tubular shape. Plural partitions 20 divide the respective terminal housing chambers 16 as shown in FIGS. 1A and 1B and the terminal housing chambers 16 form a row at predetermined intervals. The terminal housing chambers 16 respectively have resilient latches 21 to hold terminals 18 therein.

The resilient latches 21 are integrally extended from the respective inner surfaces 16*a* of the terminal housing chambers 16 as a resilient cantilever beam as shown in FIG. 1B. Each resilient latch 21 may elastically deform and a distal end thereof is allowed to displace in a vertical direction and a proximal end thereof works as a pivot for the displacement. The distal end of each resilient latch 21 comprises a latching projection 21*a* to engage with an engaging hole 33 of the terminal 18 (to be described later).

The connector housing 17 further comprises plural insertion holes 22 on the top end thereof and plural assembly holes 23 on the bottom end thereof as shown in FIGS. 1A to 3. The insertion holes 22 penetrate the upper wall portion 17*b* and are respectively connected with the terminal housing chambers 16. The insertion holes 22 allow insertion of the opposite terminals into the respective terminal housing chambers 16 from an upper side of the connector housing 17.

Each insertion hole 22 further comprises guiding bevels 24 therearound for guiding the opposite terminal. The opposite terminal slides on the guiding bevel 24 so as to be guided to the terminal housing chamber 16.

The assembly holes 23 are opened on the bottom end of the connector housing 17 as shown in FIGS. 1A, 1B, 2A and 2B. The assembly holes 23 are formed so as to slidably fit contact portions 26 of the terminals 18 (to be described later) and respectively receive the terminals 18. The assembly holes 23 are communicated with a through-hole 3*a* of the printed circuit board 3 when the connector housing 17 is fixed to the printed circuit board 3.

Each assembly hole 23 further comprises guiding bevels 25*a* therearound for guiding the opposite terminal. The width and the tilt angle of the guiding bevels 25*a* are different from those of the guiding bevels 24. The opposite terminal slides on the guiding bevel 25*a* to be guided to the terminal housing chamber 16.

The terminal 18 comprises a contact portion 26 at a distal end thereof for contacting the opposite terminal and a solder tail 27 at a proximal end thereof for fixation with the printed circuit board 3 by soldering. The contact portion 26 includes a tubular body 28 having an elastic contact piece 28*a* therein and the elastic contact piece 28*a* is positioned near the distal end of the tubular body 28. The terminal 18 further comprises a connection portion 29 so that the proximal end of the tubular body 28 is connected with the solder tail 27.

The tubular body 28 receives the opposite terminal from either end thereof. The tubular body 28 further comprises a slanted wall 28*d* on a side wall 28*c* opposed to the side wall 28*b* having the elastic contact piece 28*a* as shown in FIGS. 4, 5A to 5C. The slanted wall 28*d* is slightly slanted outward from the proximal end of the contact portion 26.

The connection portion 29 includes an extended wall 30 which is extended from a side wall 28*e* of the tubular body 28, a connection wall 31 for connecting the extended wall 30 to the solder tail 27 and a counter wall 32 opposed to the extended wall 30 being connected with the connection wall 31.

The extended wall 30 is formed in a rectangular shape and is enough elastic to allow displacement of the tubular body 28.

The end of the extended wall 30 reaches the same level as the bottom end of the connector housing 17 when the terminal 18 is installed in the terminal housing chamber 16. The end of the extended wall 30 further comprises a slanted surface 30*a*.

The connection wall 31 further comprises a slanted wall 31*a* at an opposite end to the solder tail. The slanted wall 31*a* has a rectangular shape and is slanted inward to the tubular body 28.

The counter wall 32 also has a rectangular shape and is substantially parallel to the extended wall 30. The counter wall 32 and the extended wall 30 are directed orthogonal to the connection wall 31. The counter wall 32 has an end aligned to the end of the extended wall 30 so that the end of the counter wall 32 also reaches the same level as the bottom end of the connector housing 17. The counter wall 32 comprises a slanted surface 32*a* as the extended wall 30.

A guiding portion 34 including the slanted walls 28*d* and 31*a* and the slanted surfaces 30*a* and 32*a* guides the opposite terminal inserted from the bottom end of the connector housing 17 into the terminal housing chamber 16.

The proximal ends of the extended wall 30 and the counter wall 32 may be slightly projected from the bottom end of the connector housing 17 on the contrary to the description above. It is available that at least the proximal ends of the extended wall 30 and the counter wall 32 are not receded from the bottom end of the connector housing 17.

The solder tail 27 having a cranked portion 35 is extended from the proximal end of the connection wall 31. The solder tail 27 passes through the through-hole 3*a* of the printed circuit board 3 to the rear surface 3*c* and is solder on the rear surface 3*c*. The cranked portion 35 can be elastically deformed so as to allow displacement of the terminal 18 within the terminal housing chamber 16.

Figure 2A:
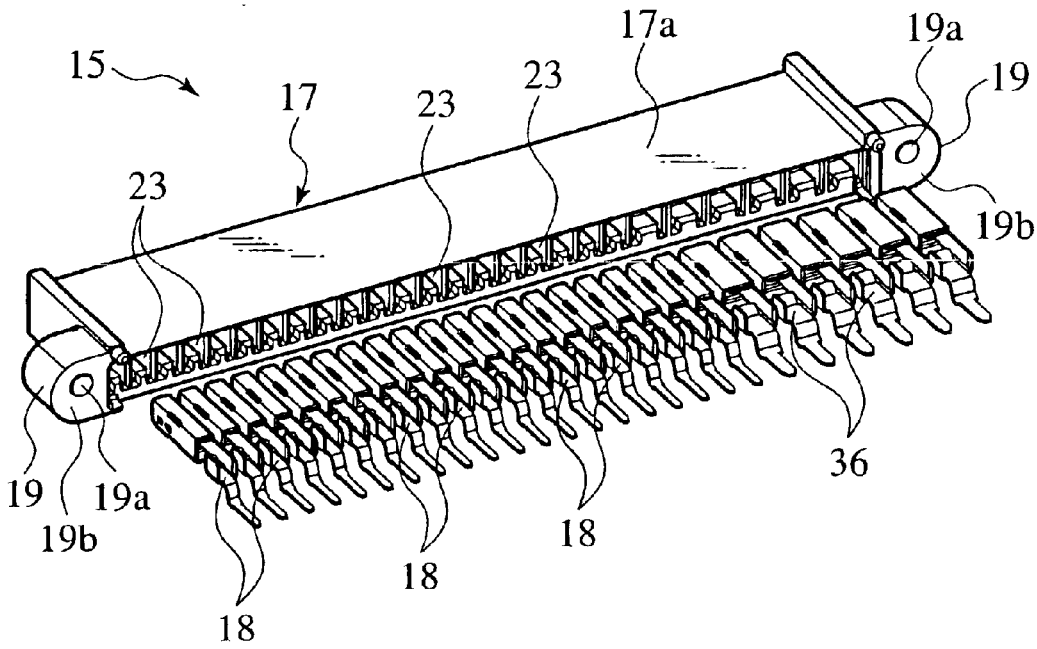
FIG. 2A is an exploded perspective view of the connector of the embodiment.
Figure 2B:
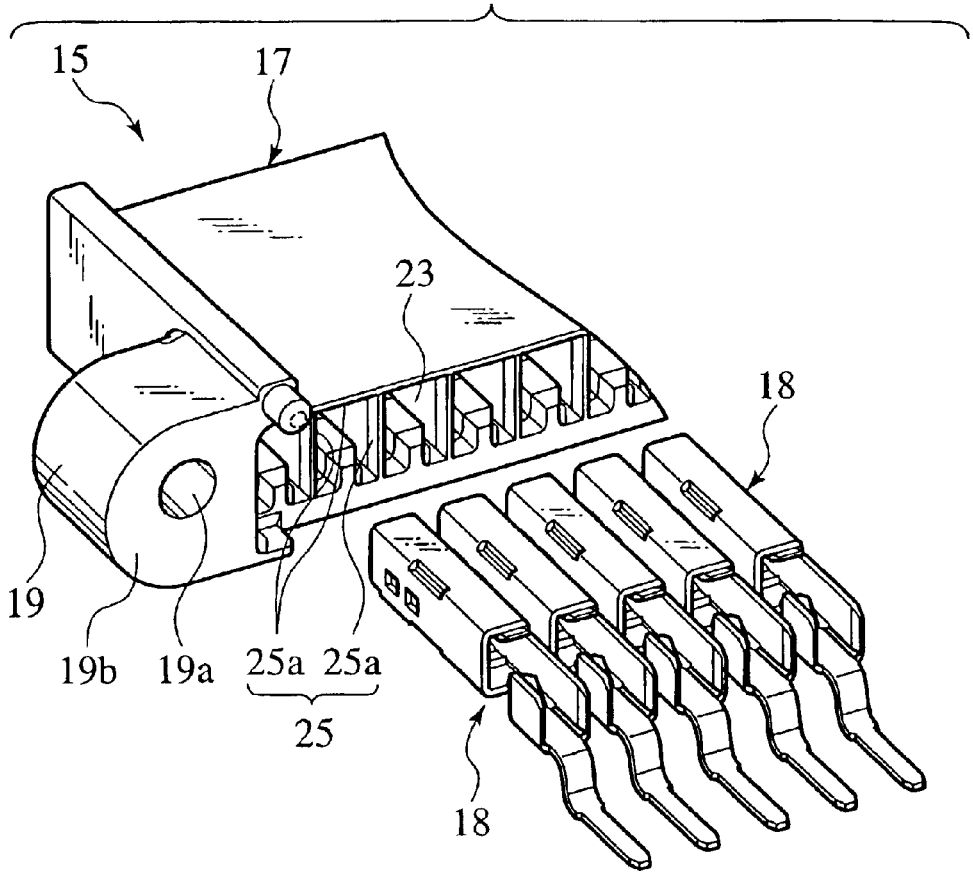
FIG. 2B is an enlarged partial perspective view of the connector of the embodiment.
Figure 3:
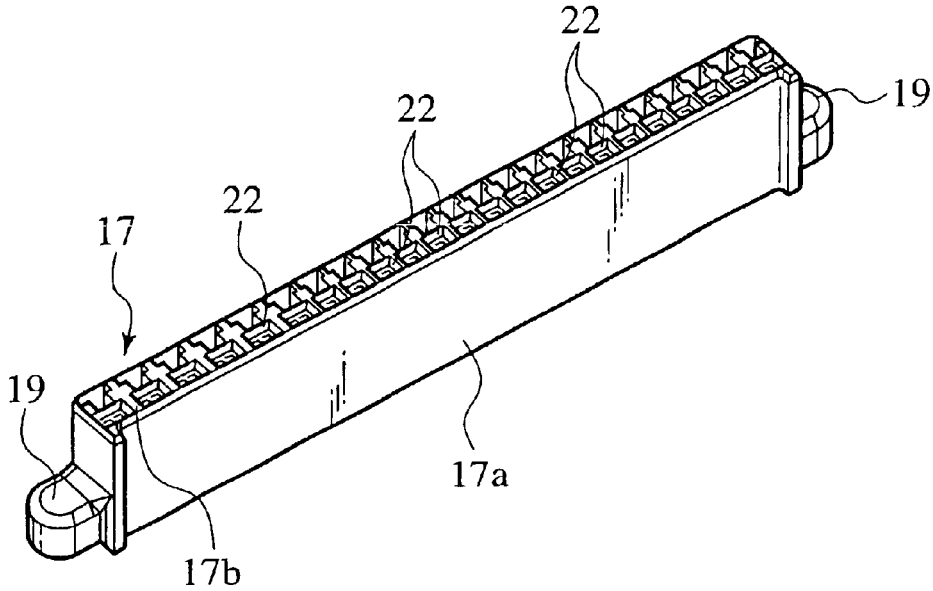
FIG. 3 is a perspective view of the connector of the embodiment.
Figure 4:
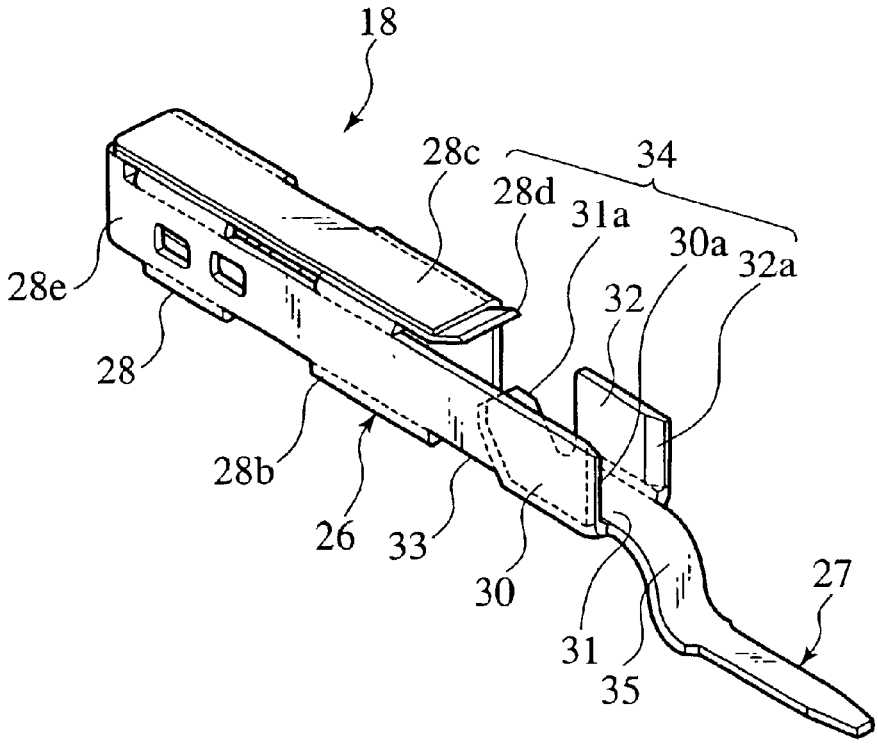
FIG. 4 is a perspective view of a terminal of the connector of the embodiment.
Figure 5A:
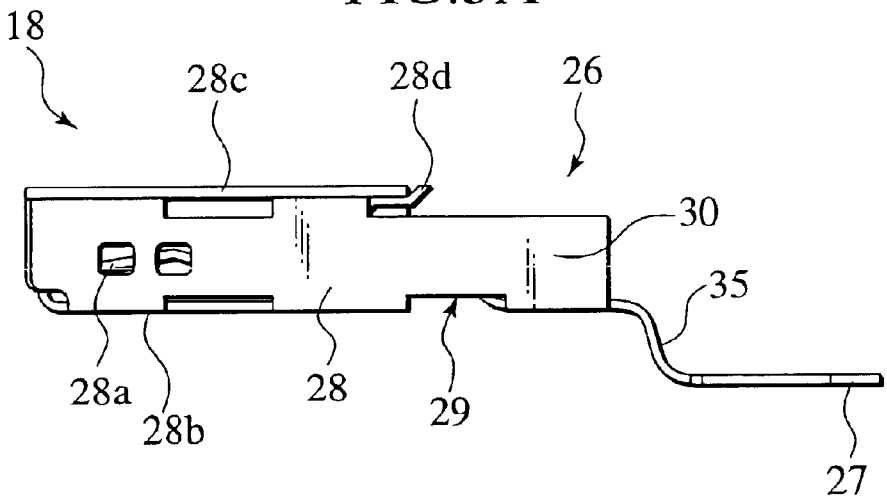
FIG. 5A is a side view of the terminal of FIG. 4.
Figure 5B:
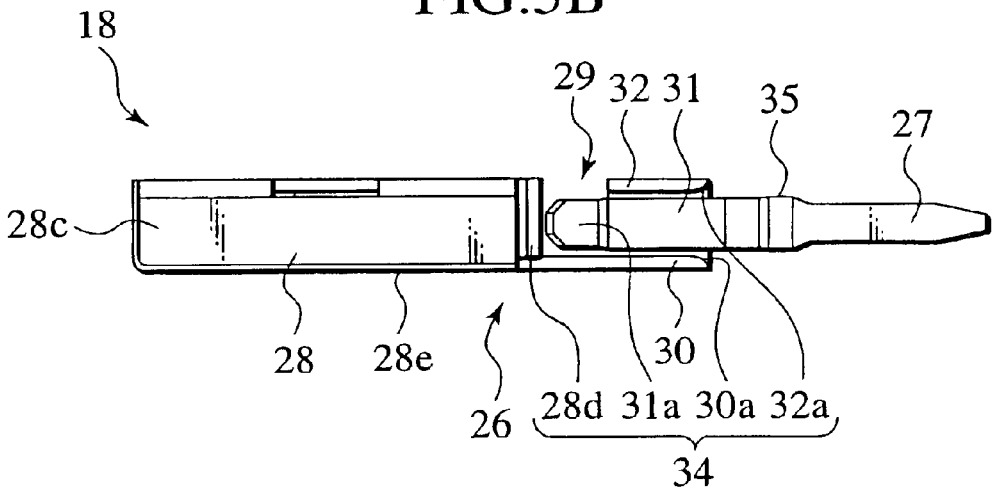
FIG. 5B is a top plan view of the terminal of FIG. 4.
Figure 5C:
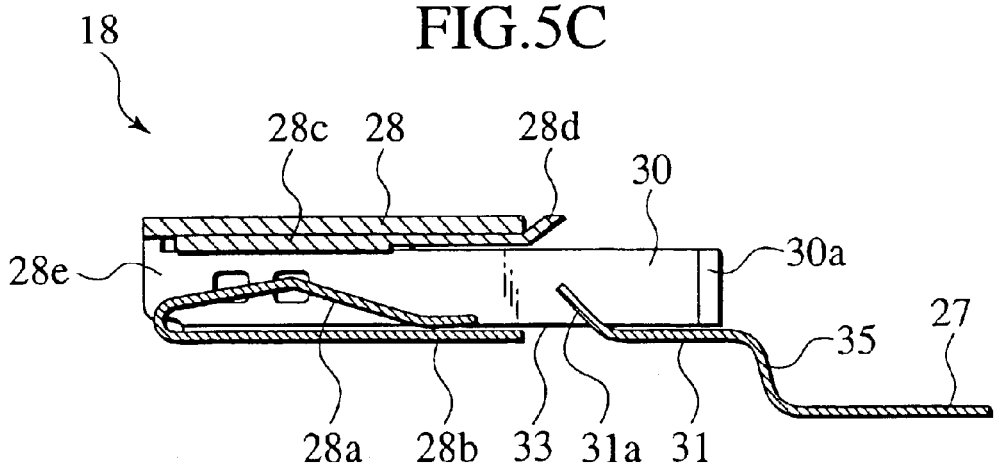
FIG. 5C is a vertical cross sectional view of the terminal of FIG. 4.
Figure 6A:
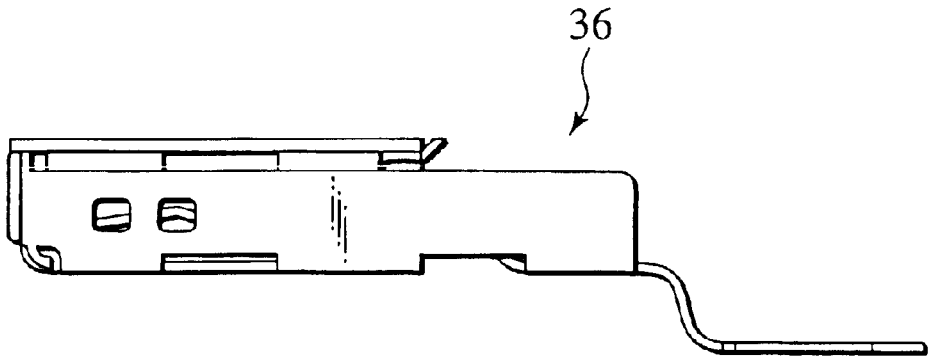
FIG. 6A is a side view of another terminal of the connector of the embodiment.
Figure 6B:
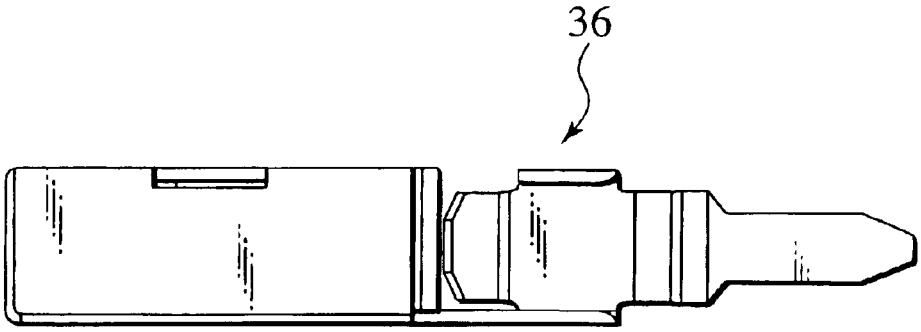
FIG. 6B is a top plan view of the terminal of FIG. 6A.
Figure 6C:
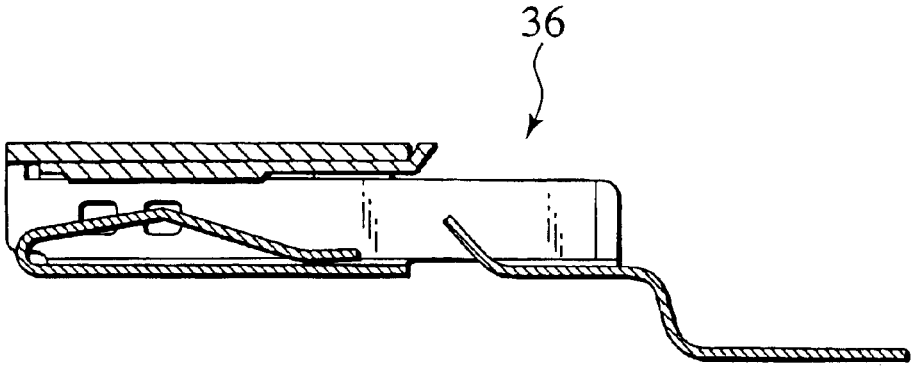
FIG. 6C is a vertical cross sectional view of the terminal of FIG. 6A.

Another type of terminals 36 are applied to the connector 15 as shown in FIGS. 2A, 2B and 3. The terminal 36 has the same constitution as the terminal 18 and a width thereof is slightly larger.

The opposite terminals are housed in a connection box and such and the connection box is connected to the connector 15. Either the top end or the bottom end of the connector 15 is available for the connection with the connection box. Selection of ends depends on an arrangement of the opposite terminals in the connection box and such.

When the connection box is pressed to the top end of the connector 15, the opposite terminals are respectively inserted into the terminal housing chambers 16 from the insertion holes 22 and contact the contact portions 26 of the terminals 18, 36. Then the opposite terminals are in electrically contact with the terminals 18,36.

Figure 7A:
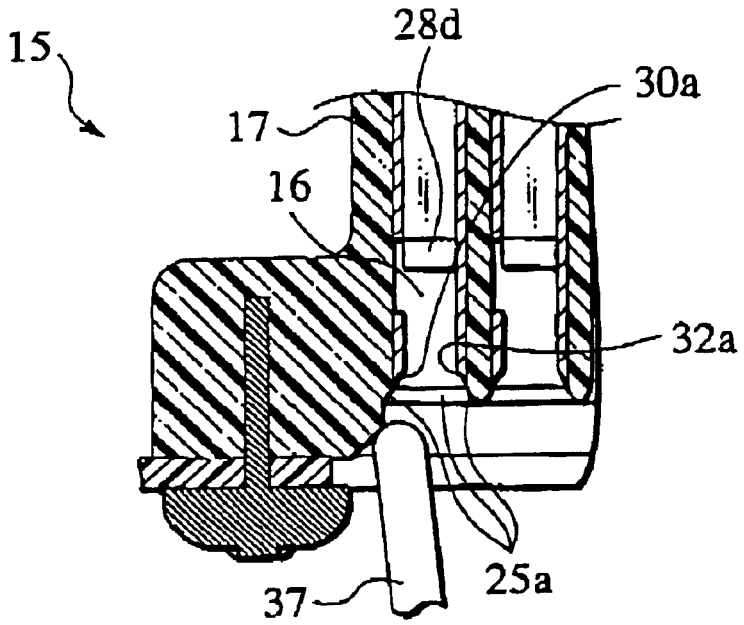
FIG. 7A is a vertical cross sectional view of the terminal of FIG. 1A in a course of inserting an opposite terminal thereto.
Figure 7B:
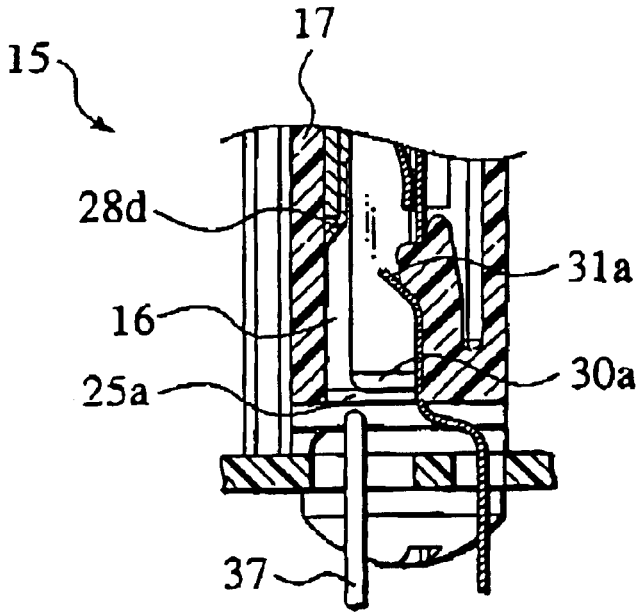
FIG. 7B is a vertical cross sectional view of the terminal of FIG. 7A, showing a cross section orthogonal to FIG. 7A.

The opposite terminals 37 may be inserted from the bottom end of the connector 15 as shown in FIGS. 7A and 7B. In a case where the arrangement of the opposite terminals in the connection box do not accurately match the arrangement of the terminal housing chambers 16, the bottom end may allow insertion of the opposite terminals because the width and the tilt angle of the guiding bevels 25*a* differ from those of the guiding bevels 24. Either end may tolerate the arrangement error.

When assembling the connector 15, first the terminals 18 and 36 are relatively inserted into the terminal housing chambers 16 from the assembly holes 23, and second the connector housing 17 is fixed to the printed circuit board 3.

When the terminals 18 and 36 are pressed so that the proximal ends thereof are aligned to the bottom end of the connector housing 17, the terminals 18 and 36 are completely housed in the terminal housing chambers 16. Thereby any machine for further pressing the terminals 18 and 36 to be recessed in the housing chamber 16 is not necessary.

The proximal ends of the extended wall 30 and the counter wall 32 are available for pressing the terminal 18 or 36. It is not necessary to use the solder tail 27 for insertion of the terminal 18 or 36 so that the solder tail 27 is prevented from deformation.

After the respective terminals 18, 36 are installed, the connector housing 17 is fixed to the printed circuit board 3 by the brackets 19 and the solder tails 27 are soldered. Thereby an installation procedure is finished.

Although the invention has been described above by reference to certain embodiments of the invention, the invention is not limited to the embodiments described above. Modifications and variations of the embodiments described above will occur to those skilled in the art, in light of the above teachings.

What is claimed is:

1. A circuit board connector comprising:

a connector housing including a plurality of adjacent terminal housing chambers each including a first open end and a second open end; and a plurality of terminals each comprising a contact portion at a distal end thereof, for contacting an opposite terminal and a solder tail extended from a proximal end thereof, the terminals being respectively and adjacently housed in the terminal housing chambers with the distal ends thereof directed to the first open ends;

each of the plurality of terminals including a wall having a length so that a proximal end of the wall reaches the same level as or slightly protrudes from the second open end when the terminal is fully inserted in the terminal housing chamber.

2. The circuit board connector of claim 1, wherein:

the second open ends respectively comprise guiding bevels for guidance of insertion of the opposite terminals.

3. The circuit board connector of claim 1, wherein:

the plurality of terminals respectively comprise guiding portions for guidance of insertion of the opposite terminals into the contact portions.

4. The circuit board connector of claim 1, wherein each of the plurality of terminal housing chambers includes a resilient latch; and wherein each of the plurality of terminals includes an engaging hole configured to engage with the resilient latch.

5. The circuit board connector of claim 1, wherein the end of the wall includes a slanted surface.

6. The circuit board connector of claim 1, wherein each of the plurality of terminals are configured to receive a contact in the proximal end.

7. A circuit board connector comprising:

a connector housing including a plurality of terminal housing chambers, each including a first open end and a second open end; and a plurality of terminals, each including, a contact portion at a distal end of the terminal, a guiding portion at a proximal end of the terminal, the contact portion and the guiding portion each being configured to receive an opposite terminal inserted through the first or second open ends, respectively, a solder tail extending from the proximal end, and a wall having a length so that a proximal end of the wall reaches the same level slightly protrudes from the second open end when the terminal is fully inserted in the terminal housing chamber.

8. The circuit board connector of claim 7, wherein: the second open end includes guiding bevels for guidance of insertion of the opposite terminals.

9. The circuit board connector of claim 7, wherein:

the guiding portions include a slanted wall and a slanted surface for guiding an opposite terminal inserted into the contact portion.

10. The circuit board connector of claim 7, wherein the end of the wall includes a slanted surface.

* * * * *

UNITED STATES PATENT AND TRADEMARK OFFICE

CERTIFICATE OF CORRECTION

PATENT NO. : 6,840,814 B2
DATED : January 11, 2005
INVENTOR(S) : Masaru Fukuda et al.

It is certified that error appears in the above-identified patent and that said Letters Patent is hereby corrected as shown below:

Column 6,
Line 27, "level slightly" should read -- level as or slightly --.

Signed and Sealed this

Twelfth Day of April, 2005

JON W. DUDAS
*Director of the United States Patent and Trademark Office*